US005640145A

United States Patent [19]

Newham

[11] Patent Number: 5,640,145

[45] Date of Patent: Jun. 17, 1997

[54] REMOTE CONTROLLED SYSTEM FOR MONITORING THE OCCUPANCY OF AN INFANT BEARING DEVICE

[75] Inventor: Paul F. Newham, San Antonio, Tex.

[73] Assignee: Bed-Check Corporation, Tulsa, Okla.

[21] Appl. No.: 321,244

[22] Filed: Oct. 11, 1994

[51] Int. Cl.[6] ..... G08B 13/14

[52] U.S. Cl. ..... 340/573; 340/568; 340/529; 340/523; 340/667; 340/666; 340/309.15; 368/12

[58] Field of Search ..... 340/573, 568, 340/571, 529, 523, 667, 666, 693, 565, 309.15; 200/85 R, 85 A; 368/12; 371/16.3

[56] References Cited

U.S. PATENT DOCUMENTS

| | | | |
|---|---|---|---|
| 4,484,043 | 11/1984 | Musick | 200/88 |
| 4,505,910 | 3/1985 | Musick | 200/85 |
| 4,565,910 | 1/1986 | Musick et al. | 200/85 R |
| 4,987,482 | 1/1991 | Nykerk | 340/565 |
| 5,079,541 | 1/1992 | Moody | 340/573 |
| 5,119,072 | 6/1992 | Hemingway | 340/573 |
| 5,235,319 | 8/1993 | Hill | 340/573 |
| 5,241,297 | 8/1993 | Choi | 340/568 |
| 5,241,300 | 8/1993 | Buschmann | 340/573 |
| 5,276,432 | 1/1994 | Travis | 340/573 |
| 5,289,163 | 2/1994 | Perez | 340/573 |
| 5,299,332 | 4/1994 | Perng | 340/573 |
| 5,317,304 | 5/1994 | Goodman | 340/568 |
| 5,379,023 | 1/1995 | Dalton | 340/568 |

*Primary Examiner*—Jeffery Hofsass
*Assistant Examiner*—Albert K. Wong
*Attorney, Agent, or Firm*—Frank J. Catalano; Scott R. Zingerman

[57] ABSTRACT

A system for monitoring an infant-bearing device includes a microprocessor responsive to a resident program. A first circuit connected to the microprocessor and to a sensor automatically activates operation of the microprocessor to a "monitor" mode upon detection of the infant's presence, maintains operation of the microprocessor for a predetermined time period at least equal to a running time of the program and terminates operation of the microprocessor at the expiration of the predetermined time period if termination of the patient's presence occurs prior to expiration of the predetermined time period. A second circuit operates the system in response to signals received from a remote control device to deactivate the system from the "monitor" mode. The microprocessor is further responsive to the first circuit to activate the system to the "monitor" mode after deactivation if the sensor subsequently detects termination and resumption of the infant's presence on the device. A third circuit connected to the microprocessor provides an audio/alarm upon demand by the microprocessor. The microprocessor is responsive to the first circuit to switch the system from the "monitor" mode to an "alarm" mode and trigger the third circuit to generate an alarm after termination of the infant's presence on the device after the system has been activated to the "monitor" mode. The microprocessor is responsive to the first circuit after the sensor detects resumption of the infant's presence or to the signals received from the second circuit. Alternatively, resumption of the infant's presence on the device will not cease the alarm. The alarm will cease after a predetermined period of time.

12 Claims, 5 Drawing Sheets

REMOTE CONTROLLED SYSTEM FOR MONITORING THE OCCUPANCY OF AN INFANT BEARING DEVICE

BACKGROUND OF THE INVENTION

This invention relates generally to infant-bearing devices such as carriages, strollers, carseats, playpens, high chairs or the like and more paticularly concerns remote control systems for parental or custodial monitoring of the presence or absence of an infant in or from an infant bearing device.

Systems presently exist for long and short term monitoring of occupancy of adult bearing devices, such as hospital beds, wheelchairs, and the like. Devices of this type are disclosed in U.S. Pat. Nos. 4,484,043 and 4,565,910; and in U.S. patent applications Ser. No. 08/311,418 entitled "Mobile Battery Powered Patient Bed and Chair Occupancy Monitoring System and U.S. patent application Ser. No. 08/311,588, entitled "Hard-Wired Monitoring System for Hospital Bed or Short Term Care Patients", both filed by the present assignee on Sep. 23, 1994. None of these known devices is suitable for reducing the risks of infant abduction from an infant bearing device or to enhance the opportunity to detect the situation and/or minister to the needs of an infant who has become unsatisfactorily positioned in or fallen from a high chair, carseat or the Among other reasons, these known systems are not suitable for monitoring an infant's occupancy of an infant bearing device because they can be locally manipulated to disconnect or disarm the device. Many are hard-wired and do not permit mobility of the infant bearing device. They are generally not programmable and, whether programmable or not, are designed to operate in response to events likely to occur in the monitoring of an adult and not to meet the requirements imposed in monitoring an infant.

It is, therefore, an object of this invention to provide a system for monitoring the occupancy of an infant in an infant-bearing device. A further object of this invention is to provide a remotely controlled system for monitoring the occupancy of an infant in an infant-bearing device. Yet another object of this invention is to provide a system for monitoring the position of an infant in an infant bearing device. A further object of this invention is to provide a system which emits an audible alarm tending to discourage infant abduction. Another object of this invention is to provide a system which emits an alarm which is not unduly oppressive to an infant when the infant ceases occupancy of an infant bearing device. And it is an object of this invention to provide a system not easily detectable by third parties for monitoring the occupancy of an infant-bearing device.

SUMMARY OF THE INVENTION

In accordance with the invention, a system for monitoring an infant-bearing device having a sensor thereon for detecting the presence of an infant on the device includes a microprocessor responsive to a resident program. A first circuit connected to the microprocessor and to the sensor automatically activates operation of the microprocessor to a "monitor" mode upon detection by the sensor of the infant's presence on the device, maintains operation of the microprocessor for a predetermined time period at least equal to a running time of the program and terminates operation of the microprocessor at the expiration of the predetermined time period if termination of the patient's presence on the device is detected by the sensor prior to expiration of the predetermined time period. A second circuit operates the system in response to signals received from a remote control device. The microprocessor is responsive to the signals received from the second circuit to deactivate the system from the "monitor" mode. The microprocessor is further responsive to the first circuit to activate the system to the "monitor" mode after the system has been deactivated from the "monitor" mode if the sensor subsequently detects termination of the infant's presence on the device and resumption of the infant's presence on the device. A third circuit connected to the microprocessor provides an audio alarm upon demand by the microprocessor. The microprocessor is responsive to the first circuit to switch the system from the "monitor" mode to an "alarm" mode and trigger the third circuit to generate an alarm if the sensor detects termination of the infant's presence on the device after the system has been activated to the "monitor" mode. The microprocessor is responsive to the resident program to delay switching to the "alarm" mode and generating of the alarm for a predetermined time after detection by the sensor of termination of the infant's presence on the device.

In one preferred embodiment, the microprocessor is responsive to the first circuit to switch the system from the "alarm" mode to the "monitor" mode and disarm the third circuit to cease the alarm after the sensor detects resumption of the infant's presence on the device and also responsive to the signals received from the second circuit to switch the system from the "alarm" mode to the "monitor" mode and disarm the third circuit means to cease the alarm. In an alternative preferred embodiment the resumption of the infant's presence on the device will not switch the system back to the "monitor" mode or cease the alarm. In either embodiment, the microprocessor is responsive to the resident program to switch the system from the "alarm" mode to the "monitor" mode and disarm the third circuit to cease the alarm after a predetermined period of time. The system may also include a programmable device allowing the user to select either of the preferred alternative embodiments. Preferably, the microprocessor is responsive to the first circuit to cause the third circuit to generate a momentary audio alarm, perhaps two beeps, to indicate that the system is activated to the "monitor" mode.

As a failsafe, the microprocessor is further responsive to disconnection of the first circuit from the microprocessor after the system is activated to the "monitor" mode to cause the third circuit means to generate an alarm to indicate that the system is not operable. Disconnection of the first circuit occurs upon the sensor being electrically disconnected from the first circuit, the sensor being electrically disconnected from the microprocessor, or an insufficient voltage supply from a voltage source in the first circuit to operate the system.

BRIEF DESCRIPTION OF THE DRAWINGS

Other objects and advantages of the invention will become apparent upon reading the following details description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
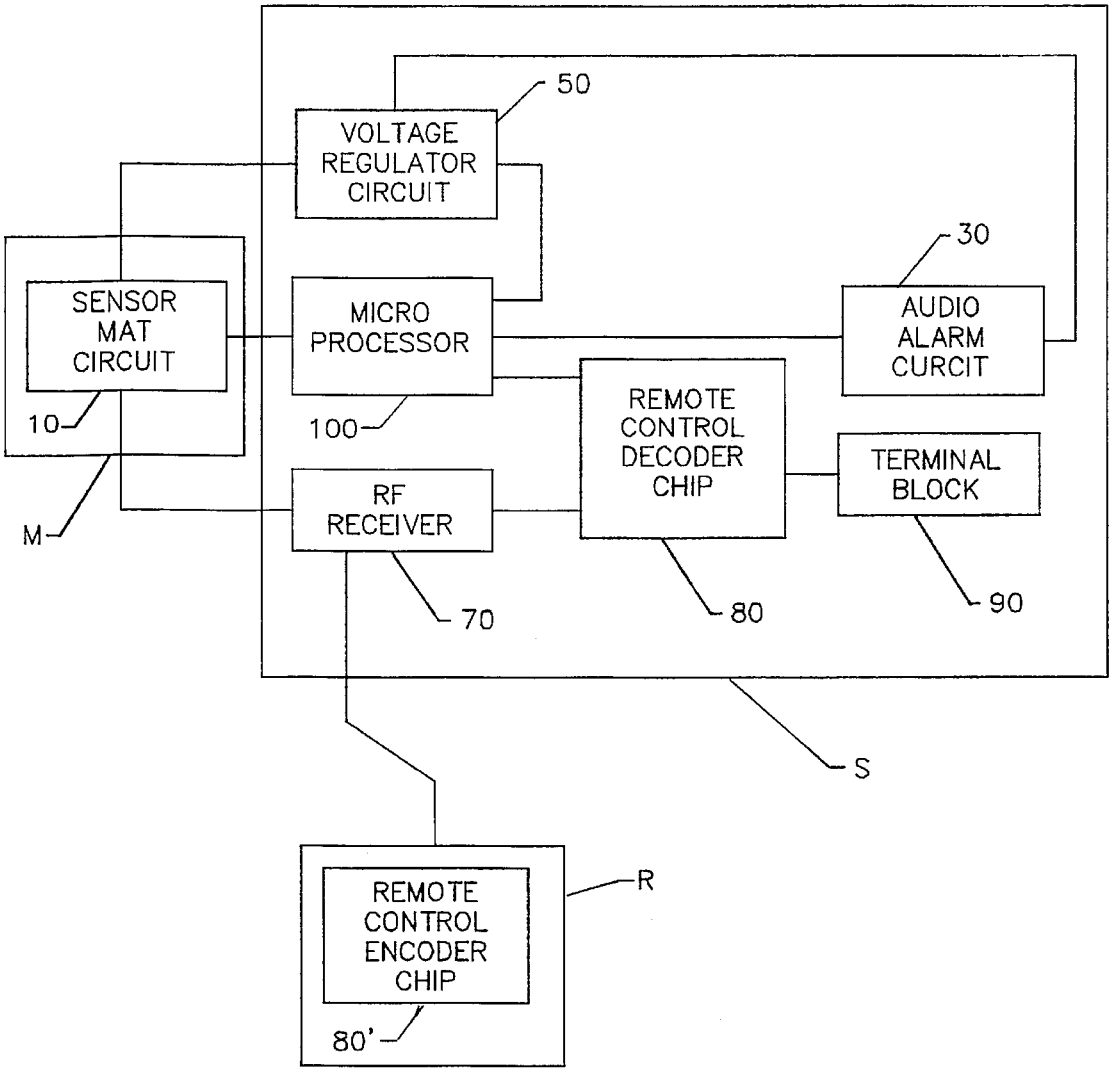
FIG. 1 is a block diagram of a preferred embodiment of the remote control system for monitoring the occupancy of an infant bearing device.

Turning first to FIG. 1, the monitoring system S is connected to a sensor mat circuit 10 associated with a sensor mat M which is disposed on the infant-bearing device to be monitored and includes an audio alarm circuit 30, a voltage regulator circuit 50, an RF receiver circuit 70, a remote control reader chip 80, a terminal block 90 and a microprocessor 100 connected in configuration and for operation as hereinafter explained. A remote control device R contains a remote control encoder chip 80' which compliments the remote control decoder chip 80 of the system S.

Figure 2:
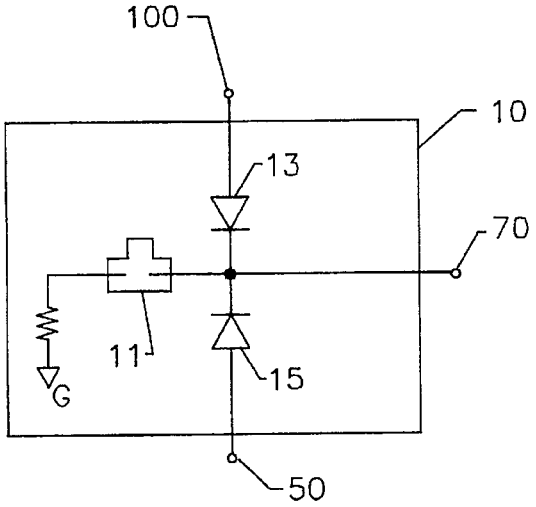
FIG. 2 is a schematic diagram of a preferred embodiment of a sensor mat circuit for use with the system of FIG. 1.

Turning now to FIG. 2, the sensor mat circuit 10 of the monitoring system S is illustrated. A monitoring sensor device such as the pressure sensitive mat M has its switching circuit 11 connected on one side to ground G and on its other side through a first blocking diode 13 to a terminal of the microprocessor 100, through a second blocking diode 15 to the voltage regulator circuit 50 and through the resistor 71 and to the RF receiver circuit 70. Thus, the grounding of the circuit 10 by application of pressure to the mat M by the presence of the infant causes a signal to be delivered to the microprocessor 100 and automatically activates the system S after lapse of a time delay, preferably approximately 3 seconds, built into the program of the microprocessor 100. This terminal of the microprocessor 100 is connected via one diode 75 to the voltage source V and via a second diode 77 to ground to provide static protection to the microprocessor 100.

Figure 3:
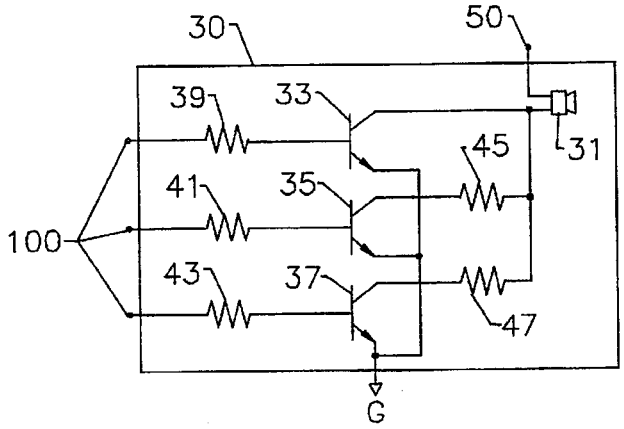
FIG. 3 is a schematic diagram of a preferred embodiment of an audio alarm circuit for use with the system of FIG. 1.

The audio alarm circuit 30 is shown in detail in FIG. 3 and includes an audio alarm 31 connected between a voltage source V in the voltage regulator circuit 50 and ground G. Three transistors 33, 35 and 37 have their bases connected through three resistors 29, 41 and 43 to output terminals on the microprocessor 100. The emitter of each of the transistors 33, 35 and 37 is connected to ground G. The collector of the first transistor 33 is connected directly to the audio alarm 31 to provide the highest level audio alarm. The collector of the second transistor 35 is connected through a resistor 45 to the audio alarm 31 to provide an intermediate level audio alarm. The collector of the third transistor 37 is connected through another resistor 47 having resistance greater than the resistance of the second transistor resistor 45 to the audio alarm 31 to provide the lowest level of audio alarm. Thus, the audio alarm level and duration is determined by the resident program of the microprocessor 100. In one preferred embodiment, the alarm time will be stepped in volume increments to produce an initial continuous tone incrementally increasing in volume to a threshold at which the level continues to increase in intermittent increments to a maximum, at which time the alarm ceases, the entire alarm period normally extending for approximately 30 seconds from its lowest to its highest level.

Figure 4:
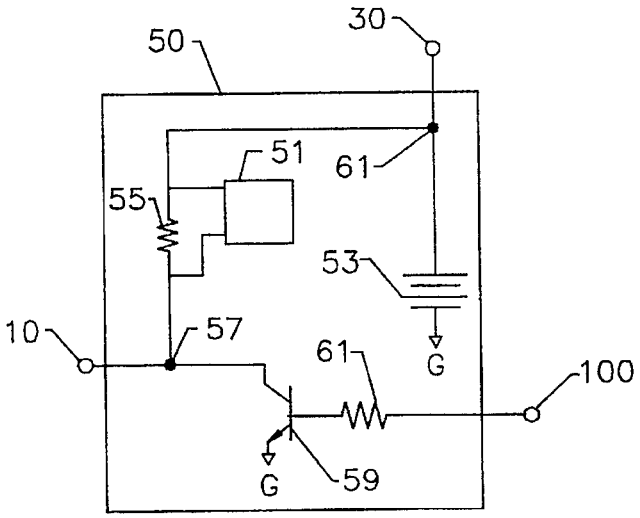
FIG. 4 is a schematic diagram of a preferred embodiment of a voltage regulator circuit for use with the system of FIG. 1.

The voltage regulator circuit 50 of the monitoring system S is illustrated in FIG. 4 and includes a voltage regulator 57 connected to a power source such as the battery 53 on the input side. Typically, the battery 53 will be 9 volts and the regulated voltage V will be 5 volts. The control voltage to the voltage regulator 51 is applied from the battery 53 through a resistor 55 to the voltage regulator control terminal 57. A transistor 59 has its collector connected to the control terminal 57 and its emitter connected to ground G. The base of the transistor 59 is connected through a resistor 61 to a terminal of the microprocessor 100. The control terminal 57 is also connected through the blocking diode 15 to the sensor mat circuit 10. The input terminal 61 of the voltage regulator 51 is also connected to the alarm circuit 30. If the mat circuit 10 is connected to the monitoring system S without any pressure being applied to the mat M, no power is delivered to the microprocessor 100. Upon application of pressure to the mat M, the second blocking diode 15 is grounded, causing the voltage applied at the voltage regulator control terminal 57 to go low, thus energizing the voltage regulator 51 and causing power to be applied to the microprocessor 100. The microprocessor 100 then immediately causes the transistor 59 to be turned on for a predetermined time interval, perhaps 30 to 40 seconds, to maintain power to the microprocessor 100 as it proceeds through its program, even if the initiating pressure is removed from the mat M. In addition, the presence of pressure on the mat M grounds the first blocking diode 13 and causes its associated terminal on the microprocessor 100 to go low, thus indicating to the microprocessor 100 that pressure has been applied to the mat M. If the pressure on the mat 90 is released before the predetermined time delay, perhaps of 30 to 40 seconds, the transistor 59 will be turned off at the end of the delay period, thus shutting off the microprocessor 100 until the mat M again has pressure applied to it. It should also be noted that the second blocking diode 15 prevents the mat pressure detection terminal of the microprocessor 100 from going low under the influence of the transistor 59, thus assuring that the full power of the battery 53 will not be applied to the microprocessor 100.

Returning to FIG. 1, parental control of the system S is accomplished by the combination of the RF receiver 70, the remote control decoder chip 80 and its associated remote control encoder chip 80' in the remote control unit R and the terminal block 90. The terminal block 90 is a standard address select device which can be set to establish the specific code that will remotely operate the system S. With the remote control decoder chip 80 set to recognize a specific code, the microprocessor 100 is responsive to the chip 80 when the RF receiver 70 receives a signal from the encoder chip 80' of the remote control unit R which is recognized as the code set in the decoder chip 80. The remote control decoder chip 80 and encoder chip 80' might be MC145027 and MC145026 manufactured by Motorola. Preferably, the wire connecting the sensor mat circuit 10 to the RF receiver 70 serves as the antenna of the RF receiver 70. Preferably, the remote R will have a range of approximately fifty feet or more. A particularly preferred sensor mat M for use with the system S is disclosed in U.S. patent application Ser. No. 08281,431, entitled "Pressure Sensitive Switch" filed by the Assignee herein on Jul. 27, 1994. The length of the mat therein disclosed would be scaled to accommodate an infant-bearing device and will likely be approximately six inches long.

Figure 5:
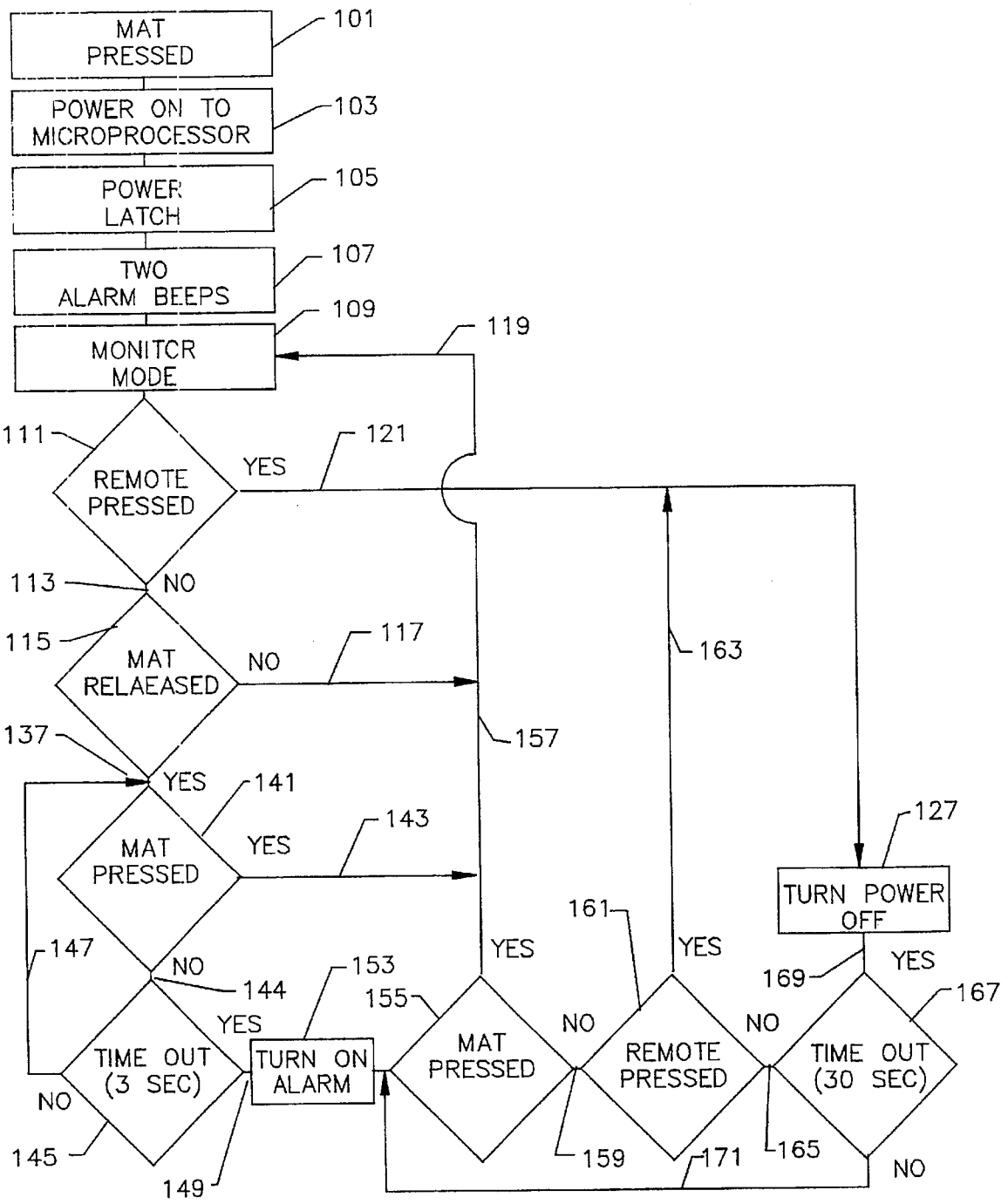
FIG. 5 is a flow chart illustrating the operation of the system of FIG. 1 under the control of a program resident in the microprocessor of the system.

Turning now to FIG. 5, a preferred function arrangement of the monitoring system S under the control of the internal software of the microprocessor 100 is illustrated. With the system S fully connected and before any pressure is applied to the mat M, no power is available at the microprocessor 100. When the mat M is pressed 101, power to the microprocessor 100 is turned on 103 and latched on 105 for the predetermined delay period by the transistor 59. The audio alarm 31 beeps twice 107 to indicate that the monitoring system is activated. The system S then proceeds to a monitor mode 109. In this condition, the system S proceeds to a monitoring loop and inquires as to whether the remote switch (not shown) has been pressed 111. If the response is NO 113, inquiry is made as to whether the mat M has been released 115. If the response to this inquiry is NO 117., the monitoring loop repeats itself many times per second 119. If, however, the response to the reset pressed inquiry 111 is YES 121, power to the microprocessor 100 will be turned off 127. If the response to the remote pressed inquiry 111 was NO 113 and the response to the mat released inquiry 115 was YES 137, inquiry is made as to whether the mat M remains in the pressed condition 141. If the response to this inquiry is YES 143, then the system S returns to the monitoring loop 119. If the answer to the mat pressed inquiry 141 is NO 144, then the system inquires at a time-out step 145 as to whether the interval during which the mat M has not been pressed satisfies the interval set in the program. If the answer to the time-out inquiry 145 is NO 147, then the routine returns to the mat pressed inquiry 141 where it is repeated until either the mat is pressed again and the routine continues through the mat pressed path 143 or the time established for the time-out step 145 is achieved and the response to the time-out inquiry 145 is YES 149. If a YES response 149 is received, then the system turns on the alarm 153. At this point, the system S again inquires as to whether the mat M is pressed 155. If the answer to this inquiry is YES 157, then the system S returns to the monitor loop 119. If the answer to this inquiry is NO 159, then the system S will again inquire as to whether the remote switch has been pressed 161. If the answer to the remote switch pressed inquiry 161 is YES 163, then the system S turns power off 127 to the microprocessor 100. If, however, the answer to the remote switch pressed inquiry 161 is NO 165, then the system S inquires at a time-out step 167 as to whether or not a predetermined interval, typically 30 seconds, has occurred in which neither the mat M nor the remote switch has been pressed. If the response to this inquiry is YES 169, then power is turned off 127 to the microprocessor. If the answer to the time-out inquiry 167 is NO 171, then the system returns to the second mat pressed inquiry 155 to continue the alarm signal for the time determined in the second time out step 167.

Figure 6:
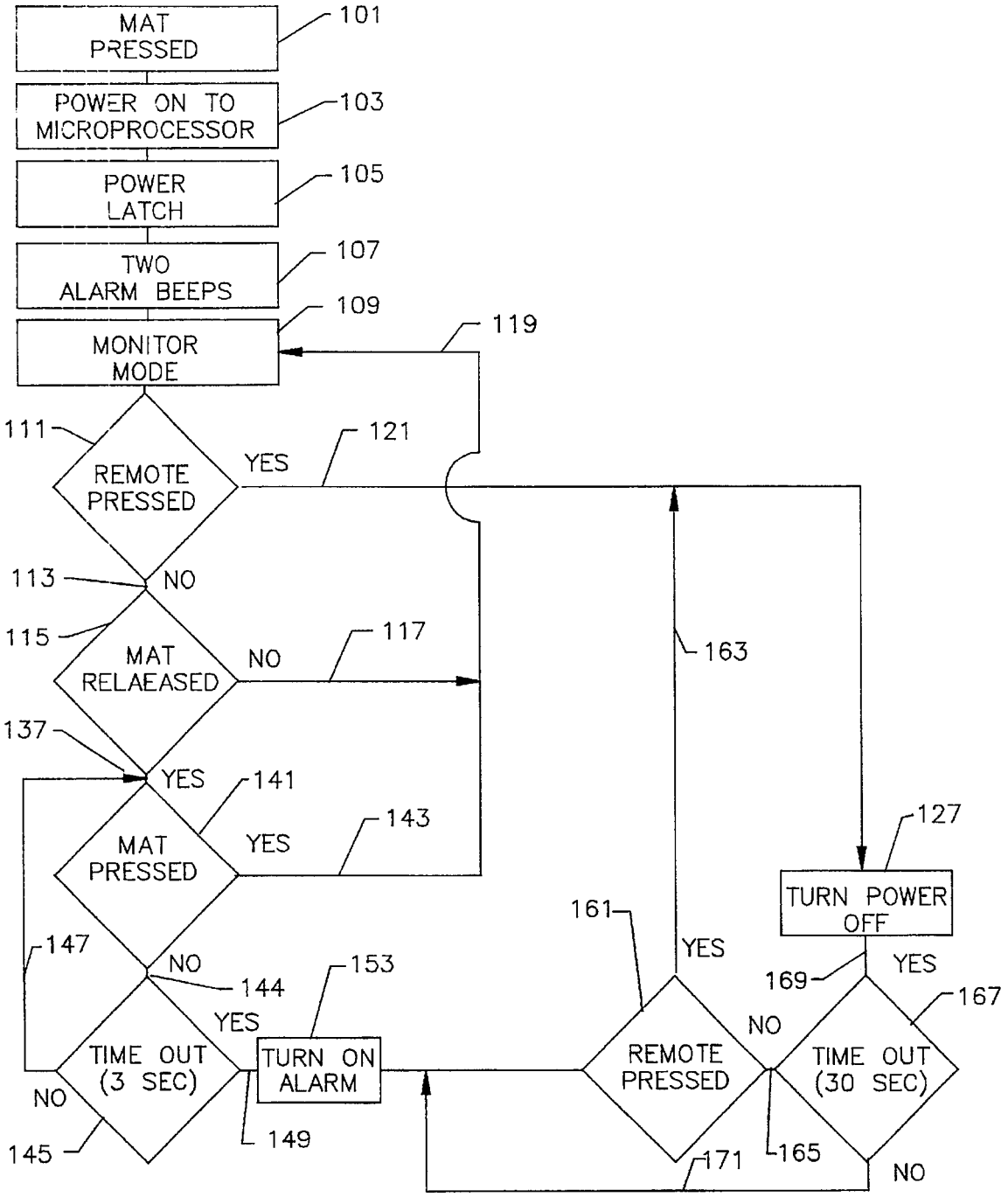
FIG. 6 a flow chart illustrating the operation of the system of FIG. 1 under the control of an alternative program resident in the microprocessor of the system.
Figure 7:
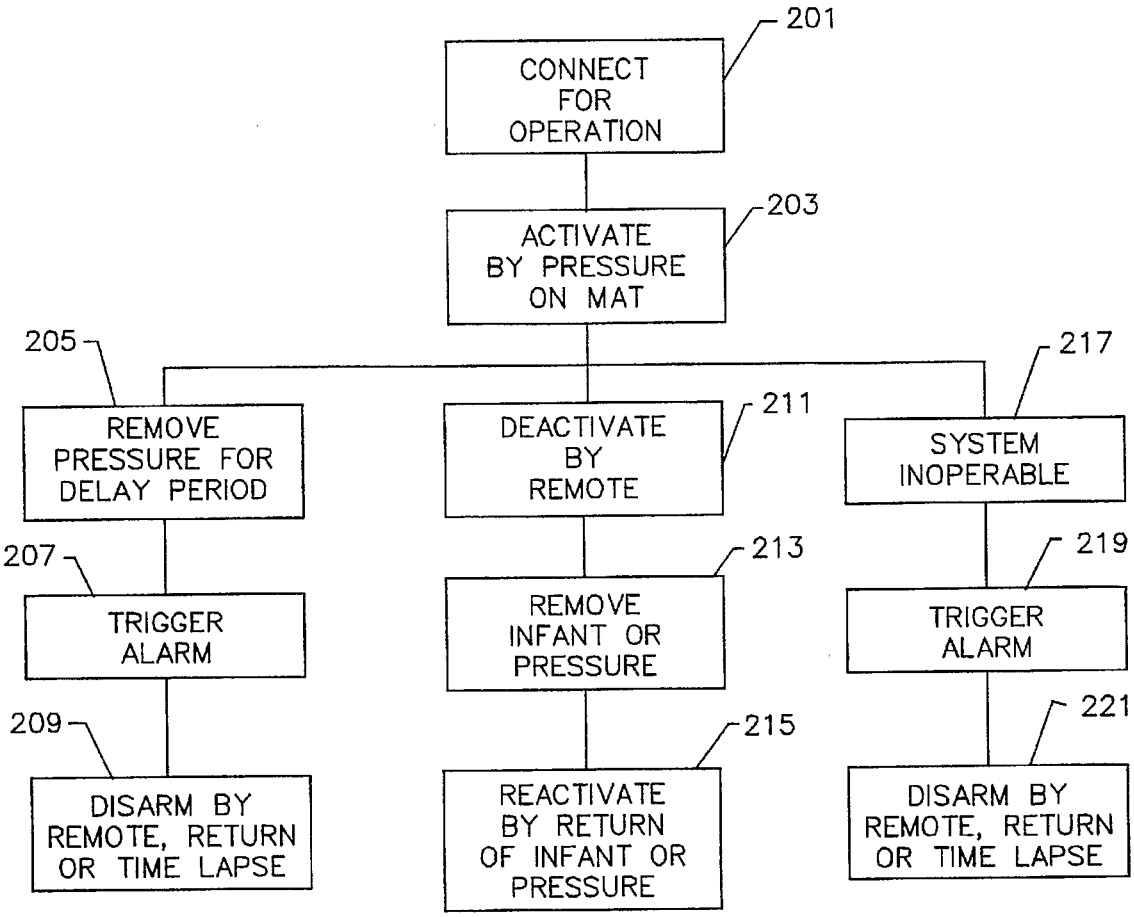
FIG. 7 is a process diagram illustrating the functions of the system from the perspective of the care person operating the system.

The function arrangement of the system S illustrated in FIG. 5 can be defeated if the infant is removed from the system and replaced within the initial time-out period by another weight sufficient to operate the sensor mat M. Thus, that function arrangement to some extent relies on the assumption that third parties do not know that the system S is being employed. Looking at FIG. 6, an alternative function arrangement of the monitoring system S is illustrated to overcome this possibility. The system illustrated in FIG. 6 is in all respects the same as the system illustrated in FIG. 5 except that the third mat pressed inquiry 155 is eliminated and the first time-out inquiry 145 may have a shorter time-out period established in the program. Thus, the delay time between removal of the infant and initiation of the alarm may be set to make it more difficult to exchange a weight for an infant. Furthermore, once the alarm is triggered, it cannot be terminated by merely pressing the mat M but requires operation of the remote R by the parent or other caregiver.

In normal operation as observed by monitoring parents or caregivers, the system S is connected for operation 201 by plugging the mat M into the system S. When pressure is applied to the mat M, the system S is activated 203 and two short beeps will be heard from the audio alarm 31. The beeps will confirm that the battery 53 is functioning and that the infant is in place on the mat M. The system S is thus in the "monitoring" mode. The infant can be adjusted in place for the selected activate time delay, if any, without triggering the alarm 31. When pressure is removed 205 from the mat M for more than the selected time delay 205, the system S will switch to the "alarm" mode and trigger the alarm 207. Pressing the remote switch or, depending on the function program selected, returning the infant to the sensor mat M, or expiration of the alarm period will disarm the audio alarm 209 and return the system S to the "monitor" mode. If it is desirable to remove the infant without sounding the alarm, deactivation can be accomplished by one press of the remote switch 211. After the infant or pressure is removed 213, the system S will be automatically reactivated by replacement of the infant or pressure 215. Once the system S is activated 203, if the sensor circuit 10 of the mat M becomes inoperable, because the mat M is disconnected from the system S or the battery 53 becomes inadequate to drive the system S, then the alarm will be triggered 219 and can be disarmed 221 as earlier explained.

Thus, it is apparent that there has been provided, in accordance with the invention, a remote controlled system for monitoring the occupancy of an infant bearing device that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A system for monitoring an infant-bearing device having a sensor thereon for detecting the presence of an infant on the device comprising:

a microprocessor responsive to a program resident therein;

first circuit means connected to said microprocessor and to the sensor for automatically activating operation of said microprocessor to a "monitor" mode upon detection by the sensor of the infant's presence on the device, for maintaining operation of said microprocessor for a predetermined time period at least equal to a running time of said program and for terminating operation of said microprocessor at the expiration of said predetermined time period after detection by said sensor of termination of the infant's presence on the device prior to expiration of said predetermined time period; and second circuit means connected between said sensor and said microprocessor for operating said system in response to signals received from a remote control device.

2. A system according to claim 1, said microprocessor further being responsive to signals received from said second circuit means to deactivate said system from said monitor "mode after activating of said system to said" monitor mode.

3. A system according to claim 2, said microprocessor further being responsive to said first circuit means to activate said system to said "monitor" mode after said system has been deactivated from said "monitor" mode and subsequent detection by the sensor of termination of the infant's presence on the device and resumption of the infant's presence on the device.

4. A system according to claim 3 further comprising third circuit means connected to said microprocessor for providing an audio alarm upon demand by said microprocessor in response to said resident program.

5. A system according to claim 4, said microprocessor being responsive to said first circuit means to switch said system from said "monitor" mode to an "alarm" mode and trigger said third circuit means to generate an alarm after said system has been activated to said "monitor" mode and subsequent detection by the sensor of termination of the infant's presence on the device.

6. A system according to claim 5, said microprocessor further being responsive to said program to delay switching to said "alarm" mode and generating of said alarm for a predetermined time after detection by the sensor of termination of the infant's presence on the device.

7. A system according to claim 5, said microprocessor further being responsive to said first circuit means to switch said system from said "alarm" mode to said "monitor" mode and disarm said third circuit means to cease said alarm after the sensor detects resumption of the infant's presence on the device.

8. A system according to claim 5, said microprocessor further being responsive to said signals received from said second circuit means to switch said system from said "alarm" mode to said "monitor" mode and disarm said third circuit means to cease said alarm.

9. A system according to claim 5, said microprocessor further being responsive to said program to switch said system from said "alarm" mode to said "monitor" mode and disarm said third circuit means to cease said alarm after a predetermined period of time.

10. A system according to claim 4, said microprocessor being responsive to said first circuit means to cause said third circuit means to generate a momentary audio alarm when said system is activated to said "monitor" mode.

11. A system according to claim 4, said microprocessor further being responsive to disconnection of said first circuit means from said microprocessor after said system is activated to said "monitor" mode to cause said third circuit means to generate an alarm.

12. A system according to claim 11, said disconnection of said first circuit means occurring upon any one of:

a. the sensor being electrically disconnected from said first circuit means;

b. the sensor being electrically disconnected from said microprocessor; and c. insufficient voltage supply from a voltage source in said first circuit means to operate said system.

* * * * *